US009896861B2

(12) United States Patent
Antinolfi

(10) Patent No.: US 9,896,861 B2
(45) Date of Patent: Feb. 20, 2018

(54) POST HOLDER

(71) Applicant: Seguro Aluminum Railings Inc., Brampton (CA)

(72) Inventor: John Antinolfi, Terra Cotta (CA)

(73) Assignee: Seguro Aluminum Railings Inc., Brampton, Ontario (CA)

( * ) Notice: Subject to any disclaimer, the term of this patent is extended or adjusted under 35 U.S.C. 154(b) by 0 days.

(21) Appl. No.: 15/146,185

(22) Filed: May 4, 2016

(65) Prior Publication Data

US 2017/0321446 A1 Nov. 9, 2017

(30) Foreign Application Priority Data

May 4, 2016 (CA) ..... 2928680

(51) Int. Cl.

| | |
|---|---|
| ***F16M 11/00*** | (2006.01) |
| ***E04H 12/22*** | (2006.01) |
| ***E04H 17/22*** | (2006.01) |
| ***E04H 17/14*** | (2006.01) |
| ***E04F 11/18*** | (2006.01) |

(52) U.S. Cl.

CPC ..... *E04H 12/2292* (2013.01); *E04F 11/1817* (2013.01); *E04H 12/2223* (2013.01); *E04H 12/2261* (2013.01); *E04H 12/2269* (2013.01); *E04H 17/1421* (2013.01); *E04H 17/22* (2013.01); *E04H 2017/1447* (2013.01)

(58) Field of Classification Search

CPC ..... F16M 11/10; F16M 11/28; F16M 11/24; F16M 11/046; F16M 11/04; F16M 2200/08; F16M 11/18; F16M 2200/028; F16M 2200/027; F16M 13/00; F16M 13/02; F16M 11/2021; F16M 11/2014; F16M 2200/048

USPC ..... 248/127, 132, 157, 161, 423

See application file for complete search history.

(56) References Cited

U.S. PATENT DOCUMENTS

| | | | | |
|---|---|---|---|---|
| 5,385,323 | A * | 1/1995 | Garelick | A47C 3/28 248/157 |
| 6,029,954 | A | 2/2000 | Murdaca | |
| 8,398,036 | B2 | 3/2013 | Svedberg | |
| 9,239,126 | B2 * | 1/2016 | Adamson | F16M 11/046 |
| 2002/0113176 | A1 * | 8/2002 | Frank | F16B 12/44 248/125.8 |
| 2002/0152713 | A1 | 10/2002 | Greco | |
| 2008/0035806 | A1 * | 2/2008 | Sporay | B63B 49/00 248/161 |
| 2009/0242864 | A1 | 10/2009 | Carney | |
| 2011/0089310 | A1 * | 4/2011 | Heintz | B60R 3/02 248/677 |
| 2014/0284980 | A1 * | 9/2014 | Dick, Jr. | B63B 29/04 297/331 |
| 2016/0097209 | A1 * | 4/2016 | Angelo | E04G 23/0229 52/297 |

FOREIGN PATENT DOCUMENTS

| | | |
|---|---|---|
| CA | 1285739 C | 7/1991 |
| CA | 2200265 A1 | 9/1998 |

(Continued)

*Primary Examiner* — Steven M Marsh

(74) *Attorney, Agent, or Firm* — The Webb Law Firm

(57) ABSTRACT

This invention relates to railings, and more particularly to post holders for hollow posts. The post holders of the present invention comprise a shaft extending from a base, and in use a post slides over the shaft of the post holder.

10 Claims, 3 Drawing Sheets

(56) References Cited

FOREIGN PATENT DOCUMENTS

| | | | |
|---|---|---|---|
| CA | 2648348 | A1 | 10/2007 |
| CA | 2706896 | A1 | 6/2009 |
| CA | 2650097 | A1 | 7/2010 |

* cited by examiner

POST HOLDER

CROSS-REFERENCE TO RELATED APPLICATION

This application claims priority to Canadian Patent Application No. 2,928,680, entitled Post Holder, filed May 4, 2016, the disclosure of which is hereby incorporated in its entirety by reference.

FIELD OF THE INVENTION

The invention relates to railings, and more particularly to post holders for securing posts for railing systems.

BACKGROUND OF THE INVENTION

Railings on platforms, such as, stairs, stoops, porches and balconies, may prevent individuals from falling off of a platform, and also provide support. Railing systems typically comprise main vertical posts supporting a top hand railing and in between the main posts a railing barrier, such as, glass panels, more posts or other barrier. Certain building codes allow only a clearance of at most four inches from the platform to the bottom of a railing system. The main vertical posts need to be attached to the platform (e.g. concrete slab or wooden deck etc.).

In a prior art system for attaching a post to a platform shown in FIG. 6*a*, a post is welded to a square base plate, and the base plate is attached to the platform by securing means such as bolts or screws through the plate into the platform. The bolts or screws extending through the plate into the platform are exposed to precipitation.

In another prior art system for attaching a post to a platform as shown in FIG. 6*b*, a post is secured to a platform through a shoe. The shoe comprises a base plate connected to a sleeve for receiving a post. The base plate of the shoe is again attached to the landing by bolts, screws or other means. A post is inserted into the sleeve. The sleeve is open to rain or snow seeping in.

In the prior art systems, in order to adjust a post's height (e.g. to keep the hand rail even), shims may be used under the base plate. In the prior art system shown in FIG. 6*b*, the sleeve of a shoe is typically three inches since certain building codes require that there should only be at most four inches clearance between the platform and the bottom of the railing barrier. This also means that there are typically three inches of post in a shoe sleeve.

Canadian Patent No. 2,200,265 entitled "Railing Assembly" demonstrates the use of a square base and Canadian Patent Application No. 2,648,348 entitled "Railings" demonstrates the use of a circular base, but in both instances the bases are screwed or bolted into the platform.

In Canadian Patent Application No. 2,650,097 entitled "Railing Post and Methods for Making and Using Same", a post is screwed onto a base plate with four screws extending into the four corners of the post from below the base plate. Canadian Patent Application No. 2,706,896 entitled "A Post Holder" provides a post holder with a sturdy base extending outwardly and a sleeve for insertion of a post. Canadian Patent No. 1285739 entitled "Post Holder Bracket" does not include a sleeve, but rather a two sided bracket.

In U.S. patent application Ser. No. 09/838,188 (Publication No. 2002/0152713) entitled "Baluster" the post is not attached to a base plate but rather elongated for attachment to the side of the base platform through securing means through the side of the bottom of the elongated post.

SUMMARY OF THE INVENTION

In an embodiment of the present invention, there is a post holder for a hollow post, said post holder comprising a shaft joined to a base, said shaft having a diameter less than the inner diameter of said hollow post.

The shaft of the post holder may additionally comprise an open channel running from a top to a bottom of the shaft. The shaft may be joined to said base with a weld, or the shaft and base may be manufactured together as one part.

In an embodiment of the invention, the shaft of the post holder is twelve inches in height, and in another embodiment the shaft is the same height as the post.

The base may be predrilled with at least one hole to be used to pass at least one bolt through the base into a platform, such as concrete slab.

The shaft and/or base of the post holder may be made of aluminum.

A post holder of the present invention may comprise a shaft having a first end and a second end, and a base supporting said second end of said shaft, said shaft having an open channel running from said first end of said shaft to said second end of said shaft.

In an embodiment of the present invention there is provided a kit of a post holder and a hollow post, said post holder comprising a shaft joined to a base, said shaft having a diameter less than the inner diameter of said hollow post, and said post capable of fitting over the post holder.

BRIEF DESCRIPTION OF THE DRAWINGS

These and other aspects of the present invention will be apparent from the brief description of the drawings and the following detailed description in which.

DETAILED DESCRIPTION OF THE INVENTION

Figure 1:
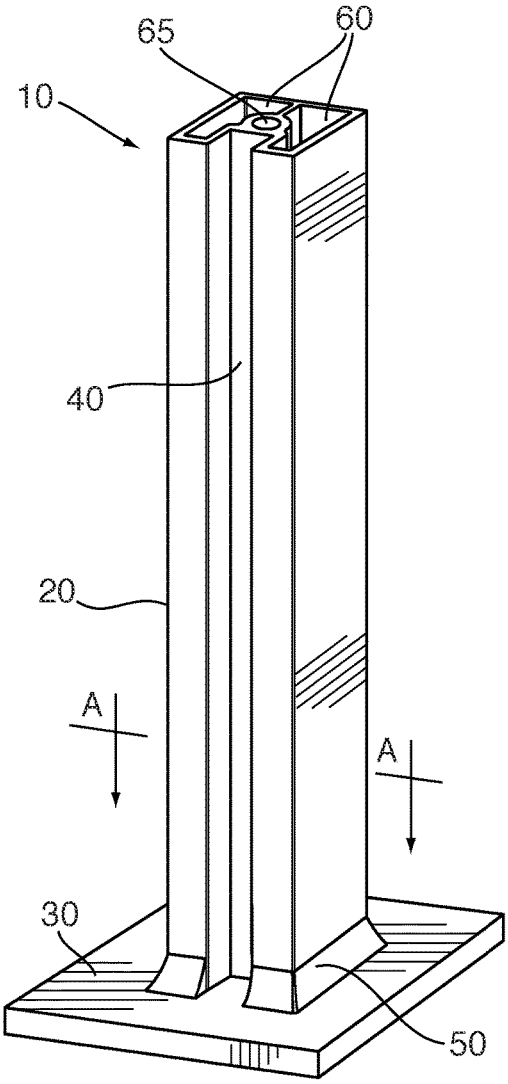
FIG. 1 is a perspective view of a post holder of an embodiment of the invention.

As shown in FIG. 1, in an embodiment of the present invention, there is a post holder 10 for holding a hollow post, in which the post holder has a base 30 and a shaft 20, and the shaft 20 is sized to fit within the interior of a post.

The shaft 20 may additionally include a weld 50 at the bottom of the shaft to attach it to the base 30, or alternatively the shaft and base can be manufactured in one piece together. When the post holder 10 is covered by a post, the weld 50 may prevent a post from being flush with the base at the bottom. For example, the weld could be 5/16 of an inch.

In this embodiment, the shaft 20 has an open channel 40 running along its length. The open channel 40 is not required, but is helpful if a railing barrier (not shown), such as a glass panel, is installed between posts since the means to attach the railing barrier to the post can extend into the open channel 40 and not interfere with the movement of the post along the post holder 10. If the shaft 20 does not include an open channel 40, a post can include a J-channel attached to it for attachment of a railing barrier so that the post may still slide unimpeded up and down the post holder 10.

The post holder can be comprised of any material which allows it to be rigid enough to support a post, for example, aluminum, steel or composites, but plastics and even wood could provide such support.

Figure 2:
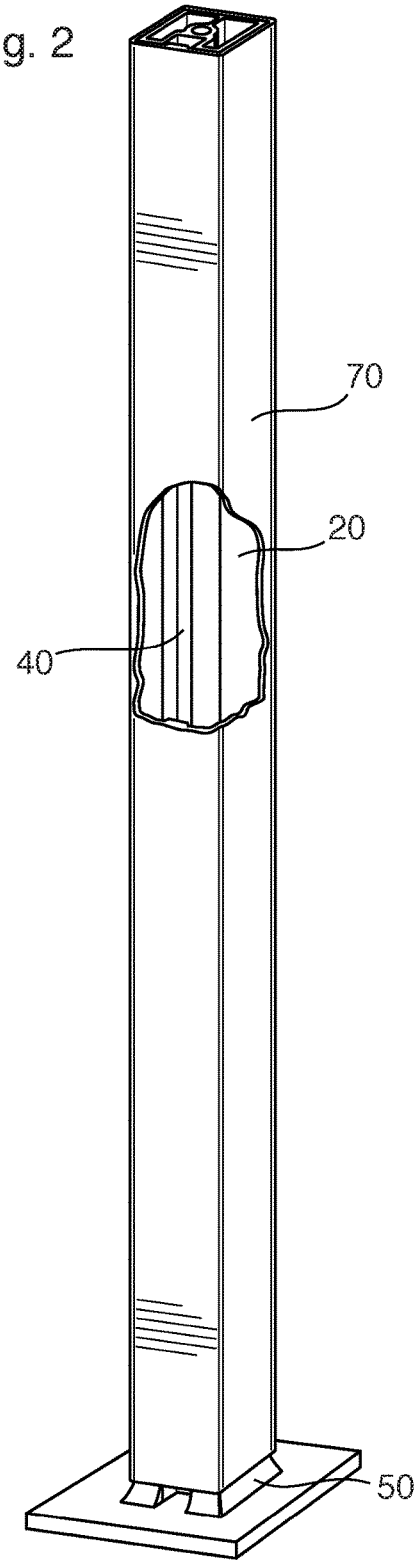
FIG. 2 is a perspective view of a post holder of an embodiment of the invention with a post, shown with a cutaway portion.

As shown in FIG. 2, a post 70 slides over the shaft 20 and the bottom of the post can rest about halfway onto the weld 50 (or flush with the base 30 in the absence of a weld 50). As a result, the post 70 slides over the shaft 20 and is not secured to the open channel 40 such that, when viewed from the top of the shaft 20, the open channel 40 remains substantially unobstructed along its length from the top to the bottom. In FIG. 2, the post 70 is partially cut away to show the channel 40 of the post holder. The post holder being shown in the embodiment shown in FIG. 2 is about the size of a post; however, the post holder 10 can be any height and perimeter which provides sufficient stability to a post. For example, the height of a post holder may be from three inches to the height of the post being used. In an embodiment of the present post holder invention shown in FIG. 1, the post holder 10 is twelve inches, and in an embodiment of the present post holder invention shown in FIG. 2, the post holder is the height of the post.

The shaft 20 has a diameter which is smaller than the inner diameter of a post 70 in order for a post to slide along it. Although a square post is shown, it will be understood that the present invention also relates to other shapes of post, e.g. circular or rectangular, since the post holder of the present invention can be adapted to the particular posts 70 being used in the railing system.

For example, a post with a circular perimeter would have a corresponding post holder with a shaft having a circular outer edge over which the post fits.

The base 30 shown in this embodiment is square, but it will be understood that the base 30 could be any shape, for example, circular, square or rectangular, that allows the shaft to be attached to the base and the base to be attached to a platform.

Figure 3:
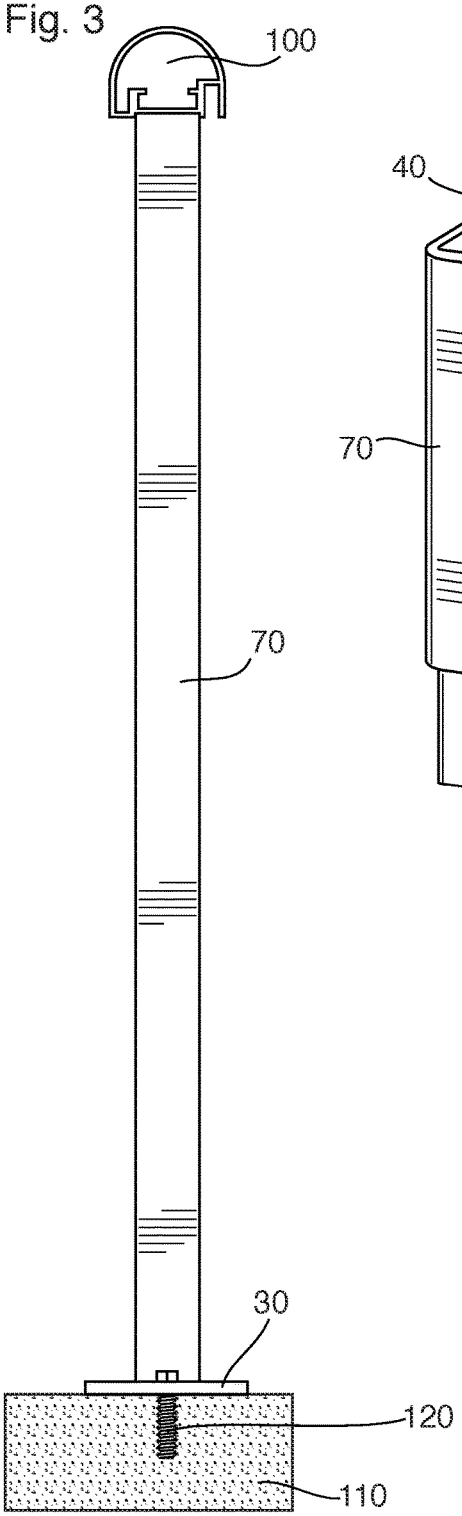
FIG. 3 is a side sectional view of a post covering the post holder of FIG. 1.

A hand rail 100 is shown in FIG. 3 at the top of the post 70. In the embodiment shown in FIG. 3, only the base 30 is shown since the post holder 10 has a shaft and base formed together. When the top of the post 70 is covered, precipitation does not enter the post or fall onto the post holder 10 except if any part of the shaft 20 is exposed by adjusting the post 70 through sliding it along the shaft 20.

The post holder is attached to a platform 110, such as a concrete slab, by base securing means 120, such as a bolt, through the base 30. The base 30 may be attached to the platform 110 with the base securing means 120 before adding the post 70, and at least one bolt and preferably two bolts may be used to secure the base 30 to the platform 120. The base 30 may be pre-punched with holes (not shown) for ease of attaching the base 30 to a platform 110. In FIG. 3, only one bolt 120 is visible and another bolt could be on the other side of the base 30.

Figure 4:
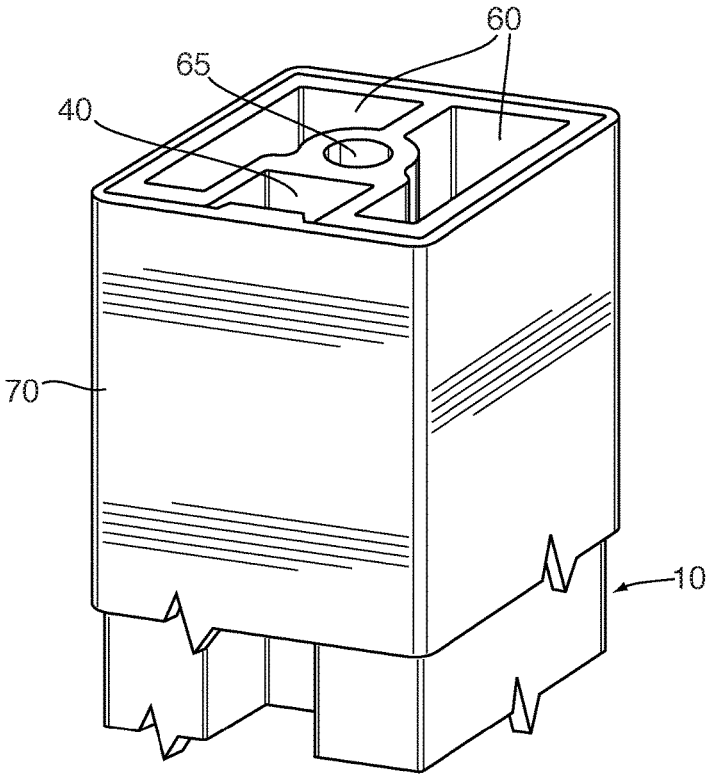
FIG. 4 is a perspective view of the top of the post holder of FIG. 1.

In FIG. 4, the post holder 10 is shown from the top, and in this embodiment the post holder is flush with the top of a post 70. However, in other embodiments a post 70 is of greater height than the post holder 10 and the post holder 10 would not be visible at the top of the post 70.

Figure 5:
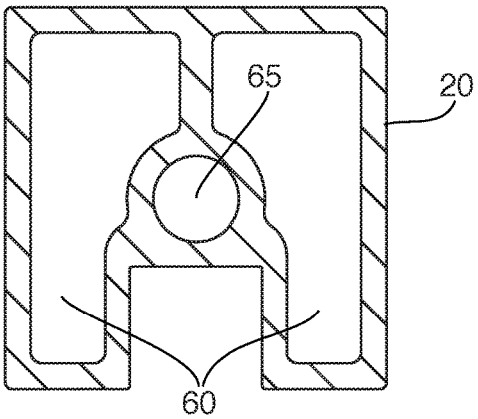
FIG. 5 is a cross-sectional view of the post holder of FIG. 1 at A-A.

In this embodiment of the post holder 10, the shaft 20 has a profile as shown in FIG. 5, which includes an inner central channel 65 and inner side channels 60. The inner channels act to provide structural support to the post holder. It is understood that the shaft may have any combination of profiles or be simply a solid or hollow shaft which is sized to fit within the desired post. The shaft has to be strong enough to support a post and not bend or break with the weight of the post, or ordinary weather conditions. The shaft of the post holder of a preferred embodiment of the present invention fits snugly into a hollow post since railings with wobbly hollow posts are generally undesirable.

In an embodiment of the present invention, the post holder 10 has a twelve inch shaft 20 and the post 70 slides over the top 90 and flat down onto the base 30 or resting on a weld 50. The shaft 20 may be a variety of heights and adjusted depending on the particular railing system. If a building code requires that the space between a platform 110 and the bottom of a railing barrier is no more than 4 inches, and the railing barrier is attached to the post, the post can slide up and down the shaft 20 to ensure that there is no more than four inches clearance (and much less if desired). When the position of a post 70 is adjusted along the shaft 20 of a post holder, the post needs to be secured in that position, which can be accomplished with one or more screws (not shown) through the side of the post into the shaft. Even if a post 70 is flush with the base 30 or weld 50 at the bottom of the post, the post can be attached to the shaft 20 with self-tapping screws. For example, for a post 70 and shaft 20 made of aluminum, such screw(s) can be stainless steel self-drilling screws and two such screws can be used.

The ability to adjust a post 70 along a post holder 10 allows accommodation for a platform's 110 curvature, slope or unevenness and removes the need to use shims which means that the base 30 sits directly on the platform 110 rather than on any shims.

Figure 6A:
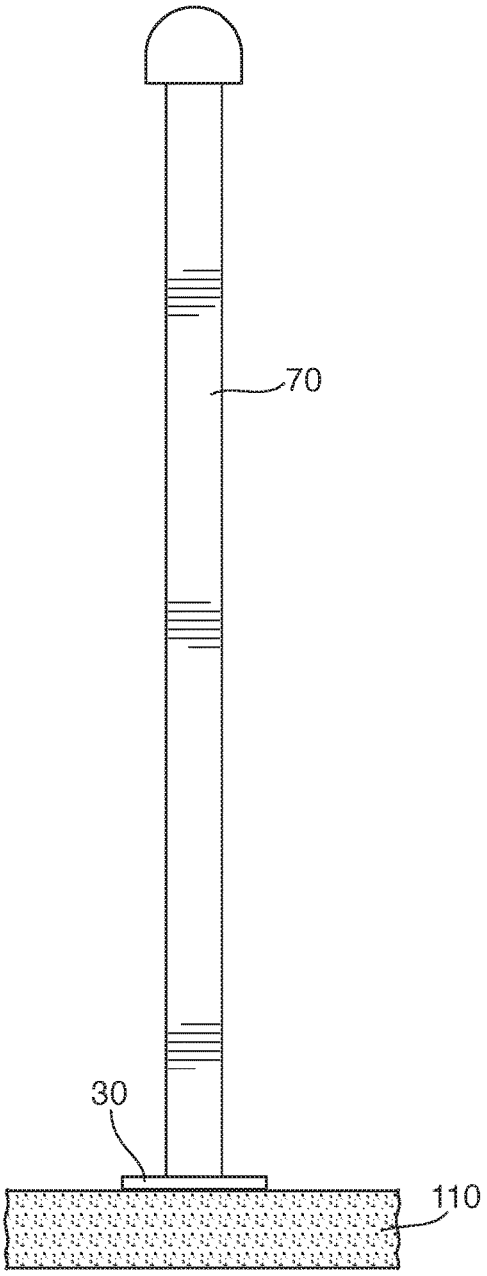
Fig. 6a Prior Art
FIG. 6*a* is a side view of a prior art post holder comprising a base.
Figure 6B:
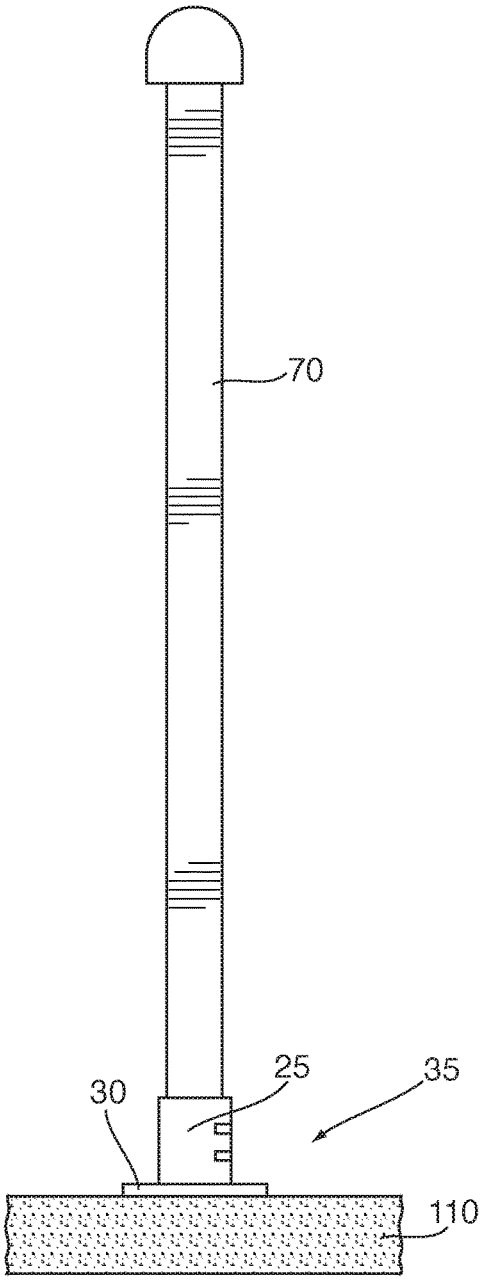
Fig. 6b Prior Art
FIG. 6*b* is a side view of a prior art post holder comprising a shoe comprising a base and sleeve.

As shown in FIG. **6*b*, the prior art shoe 35, comprises a base 30 and a sleeve 25. The height of the sleeve 25 needs to be enough so that a post 70 doesn't topple out of the shoe 25, however, the height of the sleeve 25 usually limits how low the bottom of the barrier of a railing (not shown) sits above the platform 110, since the sleeve 25 interferes with the means for attaching the barrier (typically attached to the post 70 not the sleeve 25). Unlike the shoe 35 shown in prior art FIG. 6*b*, the present invention does not use a shoe 35 with a sleeve 25 to hold a post 70 and as such, the bottom of any railing barrier is not limited by the height of the sleeve 25 of a shoe 35**.

Although there is no shoe in the prior art means shown in FIG. **6*a*, this prior art system is merely a post 70 welded onto a base 30, which base is attached to a platform 110**, and may depend for stability on the strength of the welding.

While embodiments of the invention have been described in the detailed description, the scope of the claims should not be limited by the preferred embodiments set forth in the examples, but should be given the broadest interpretation consistent with the description as a whole.

What is claimed is:

1. A post holder for holding a hollow post, said post holder comprising a shaft with a top and a bottom, said bottom of the shaft additionally comprising a weld joining the bottom of the shaft to a base, said shaft having a diameter less than an inner diameter of said hollow post, wherein the post rests upon the weld such that the weld prevents the post from being flush with the base.

2. The post holder according to claim 1, wherein said shaft additionally comprises one open channel running from the top to the bottom of the shaft.

3. The post holder according to claim 1, wherein said shaft is twelve inches in height.

4. The post holder according to claim 1, wherein said shaft is the same height as the post.

5. The post holder according to claim 1, wherein said base is predrilled with at least one hole.

6. The post holder according to claim 1, wherein said shaft and said base are made of aluminum.

7. A post holder comprising a shaft having a first end and a second end, and a base supporting said second end of said shaft, said second end of said shaft additionally comprising a weld joining the bottom of said shaft to said base, said shaft having one open channel running from said first end of said shaft to said second end of said shaft, and wherein the post rests upon the weld such that the weld prevents the post from being flush with the base.

8. A kit of a post holder and a hollow post, said post holder comprising a shaft with a top and a bottom, said bottom of said shaft additionally comprising a weld joining the bottom of said shaft to a base, said shaft having a diameter less than an inner diameter of said hollow post, and said post capable of fitting over the post holder, and wherein the post rests upon the weld such that the weld prevents the post from being flush with the base.

9. A post holder for holding a hollow post, said post holder comprising a shaft joined to a base, said shaft having a diameter less than the inner diameter of said hollow post, and said shaft additionally comprising only one open channel running substantially unobstructed from a top to a bottom of said shaft, wherein the post slides over the shaft and is not secured to the open channel such that the open channel, when viewed from the top of the shaft, remains substantially unobstructed.

10. A method of holding a hollow post on a post holder, said post holder comprising a shaft joined to a base, said shaft having a diameter less than an inner diameter of said hollow post, said shaft having only one open channel running substantially unobstructed from said first end of said shaft to said second end of said shaft, and said shaft having a height the same as or less than said hollow post, wherein said hollow post slides over said shaft to hold said hollow post on said post holder, wherein the post slides over the shaft and is not secured to the open channel such that the open channel, when viewed from the top of the shaft, remains substantially unobstructed.

* * * * *